US006659362B1

(12) United States Patent
Hallissy et al.

(10) Patent No.: US 6,659,362 B1
(45) Date of Patent: Dec. 9, 2003

(54) COMPOSITE RAILROAD TIES WITH OPTIONAL INTEGRAL CONDUIT

(76) Inventors: Gerald Hallissy, 15 Overlook Dr., Fort Washington, NY (US) 11050; William G. Higbie, 985 Thompson Dr., Bay Shore, NY (US) 11706; Edward R. Fyfe, 1339 Ocean Ave., Delmar, CA (US) 92014

( * ) Notice: Subject to any disclaimer, the term of this patent is extended or adjusted under 35 U.S.C. 154(b) by 0 days.

(21) Appl. No.: 10/095,719

(22) Filed: Mar. 12, 2002

(51) Int. Cl.[7] ..... E01B 3/00

(52) U.S. Cl. ..... 238/83; 238/35; 238/36; 238/37; 238/55

(58) Field of Search ..... 238/29, 35, 36, 238/37, 38, 55, 71, 83, 84, 87, 93, 95, 96, 97, 100, 107, 108; 425/131.1

(56) References Cited

U.S. PATENT DOCUMENTS

| | | | | | |
|---|---|---|---|---|---|
| 1,102,693 | A | * | 7/1914 | Seyler | 238/29 |
| 1,110,684 | A | * | 9/1914 | Hardmand | 238/84 |
| 1,776,422 | A | * | 9/1930 | Empey | 238/77 |
| 2,704,517 | A | * | 3/1955 | De Gracia | 104/279 |
| 3,039,695 | A | * | 6/1962 | Harmsen | 238/117 |
| 4,141,499 | A | * | 2/1979 | Ramer | 238/25 |
| 4,202,494 | A | | 5/1980 | Rumell | |
| 4,231,908 | A | | 11/1980 | Pennino | |
| 4,286,753 | A | * | 9/1981 | Lee | 238/37 |
| 4,616,055 | A | | 10/1986 | Mason | |
| 5,055,350 | A | | 10/1991 | Neefe | |
| 5,212,223 | A | | 5/1993 | Mack et al. | |
| 5,238,734 | A | | 8/1993 | Murray | |
| 5,244,726 | A | | 9/1993 | Laney et al. | |
| 5,258,222 | A | | 11/1993 | Crivelli | |
| 5,308,908 | A | | 5/1994 | Fukui et al. | |
| 5,468,539 | A | | 11/1995 | Crivelli | |
| 5,886,078 | A | | 3/1999 | Sullivan et al. | |
| 5,888,555 | A | * | 3/1999 | El-Sobky | 425/131.1 |
| 6,336,265 | B1 | * | 1/2002 | Niedermair | 29/460 |

* cited by examiner

*Primary Examiner*—Mark T. Le
(74) *Attorney, Agent, or Firm*—Brooks Kushman P.C.

(57) ABSTRACT

Railroad ties may be refurbished or have their usable life extended by overwrapping with fibrous reinforcement containing a cured matrix associated with the fibers. The ties may be machined prior to overwrapping, and are preferably sawn along their length, and conduit inserted into channels machined therein prior to adhesively bonding the sawn portions together. The conduits may be used to provide signal and power cable passages with lessened likelihood of damage thereto.

9 Claims, 4 Drawing Sheets

COMPOSITE RAILROAD TIES WITH OPTIONAL INTEGRAL CONDUIT

BACKGROUND OF THE INVENTION

1. Field of the Invention

The present invention pertains to railroad ties for use in laying track for railroad use.

2. Background Art

Railroad ties are used in enormous numbers each year. The ties support and position the track upon which railroad equipment rides, and distribute the load of the train onto the roadbed as well. The roadbed is generally formed of very coarse crushed stone. Most railroad ties are prepared from lumber. Because of the relatively large size of the ties, i.e. 6" (15 cm) by 8" (20 cm) by 8 feet (2.4 m), an enormous number of board feet of virgin lumber is consumed each year. The ties are generally preservative impregnated, i.e. with creosote and/or synthetic chemical preservatives.

Proposals to alter the nature of ties and thus limit the use of virgin lumber have been legion. For example, it has been proposed to manufacture ties from wood particles which may be obtained from smaller, more easily replaceable trees, or as scrap from the wood processing industry. However, the resulting ties do not have the strength or weatherability characteristics of wood, and may also vary in their spike holding capability. To improve upon these properties, it has been proposed in U.S. Pat. No. 4,202,494 to encase the exterior of the tie with polypropylene by injection molding the latter around the tie. However, the injection molding process for items the size of ties involves exceptionally heavy tonnage molding presses, which is capital intensive. Moreover, while the polypropylene sheath assists in minimizing water uptake, it adds little to the strength characteristics, and in cold weather or after extensive exposure to sunlight, may become brittle and crack, particularly while spike driving. Finally, the sheath also traps water within the tie, increasing susceptibility to rotting.

It has also been proposed to recycle railroad ties, thus prolonging their useful life. In U.S. Pat. No. 4,286,753, for example, railroad ties are sawn in pieces and composite wood portions adhesively bonded thereto, either on the exterior, the interior, or both. The refurbished ties have a combination of the advantages and disadvantages of both conventional wood ties and composite ties.

Associated with railroad trackage is the need to provide numerous electrical power sources and signaling means, for example to operate switches, semaphores, signal lights, railroad crossing lights, etc. In the past, the cabling necessary for power or communication has been encased in metal conduit and positioned over the roadbed ballast or within it. The conduit and cabling it contains may be subject to damage during construction and repair of the roadbed. When exposed or shallowly buried, it is subject to heaval by frost, and snagging by materials which inadvertently dangle from the train. The loss of signal capability may be extremely dangerous. For example, railroad crossings may be without warning means to notify motorists that a train is approaching.

It would be desirable to provide railroad tie products which minimize the use of virgin lumber. It would be further desirable to provide a composite tie which exhibits enhanced weatherability while maintaining strength characteristics and the ability to position and support rails with conventional spikes and plates. It would further be desirable to provide a means of cabling which minimizes the opportunity for damage to the cabling.

SUMMARY OF THE INVENTION

The present invention pertains to composite railroad ties having a core, preferably of a wood substance, the core having been wrapped around its exterior with a reinforcing fiber "overwrap" impregnated with a curable matrix composition which is subsequently cured. The core of the composite tie may comprise recycled railroad ties, or a molded composite material, and may be configured to contain one or a plurality of cable conduits. Surprisingly, spikeability and spike retention are improved over that of conventional ties. The invention further pertains to composite ties manufactured to include integral conduit.

DETAILED DESCRIPTION OF THE PREFERRED EMBODIMENT(S)

The composite ties of the present invention contain a core, preferably a wood substance core, and an external wrap of reinforcing fibers in a cured matrix. The composite ties optionally and preferably contain one or more conduits of a size suitable for carrying signal or communications cabling or electrical power cables, or both. In the case of the latter, the entire tie or a portion thereof may be made of a molded composite material, including cementious material.

Figure 1:
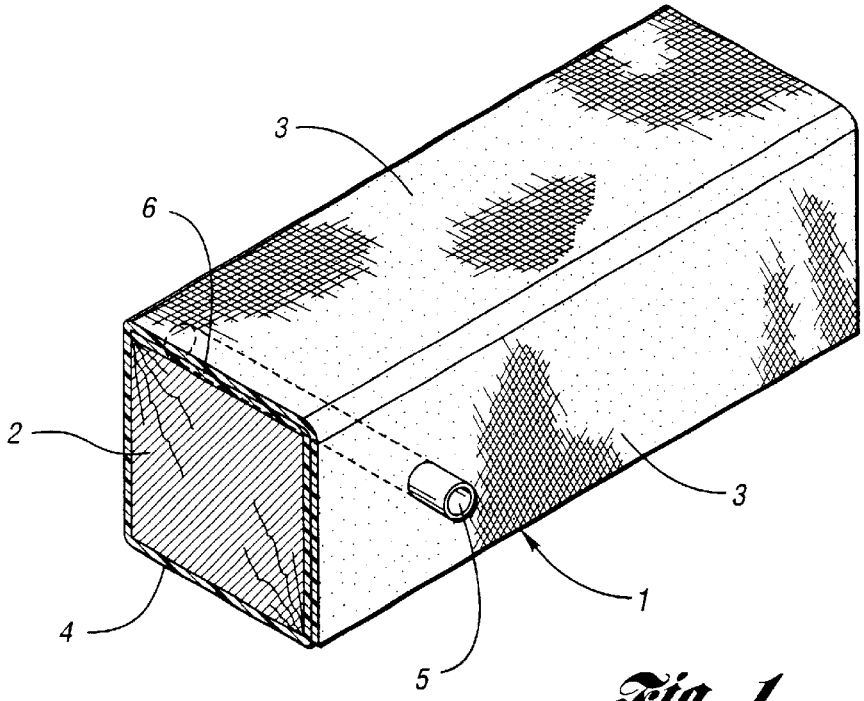
FIG. 1 illustrates one embodiment of a composite tie of the subject invention, containing an optional transverse conduit.

A typical, fiber-wrapped optionally conduit-containing tie of the present invention may be illustrated by FIG. 1. The composite tie 1 comprises a core 2 which is surrounded on the major faces 3 by a fiberwrap 4. The fiberwrap 4 consists of reinforcing fibers impregnated with a curable liquid matrix which is then cured.

The core 2 of the tie may take several forms depending upon the derivation of the core material and the intended use of the tie. In a first embodiment, the wood substance 2 of the composite tie is wood (lumber), either a single piece or a plurality of relatively large pieces adhesively bonded together, as opposed to a pressed material composed of wood chips, flakes, sawdust, etc., as one might find in particleboard, fiberboard, oriented strand board, and the like. A wood substance which constitutes a single or several large pieces of lumber may be termed a lumber wood substance herein, and a lumber wood substance comprising a single piece of lumber may be termed a single lumber wood substance.

Single lumber wood substances for the core of the composite tie may be virgin lumber or recycled lumber, and may be treated or untreated. Virgin lumber, as the name indicates, is derived from a sawing of felled trees as is used for a conventional, non-composite railroad tie. The virgin lumber is ordinarily treated with waterproofing and antirot agents as for conventional ties, i.e. with creosote, chlorinated phenol preservatives, inorganic salts deposited from aqueous solution under pressure, etc. The benefit of use of virgin lumber, preferably treated, is that a substantial increase in useful life will be expected, along with an increase in strength and modulus and also in spike holding ability. However, use of virgin lumber is not a preferred embodiment of the invention. The term "wood lumber" does not include pressed wood or molded material formed from particulates.

Preferably, the lumber wood substance of a composite tie, whether a single piece or a plurality of pieces, is derived in major part, i.e. greater than 50 volume percent, from a used tie which is to be recycled or "refurbished." More preferably, lumber from recycled ties constitutes greater than 70 volume percent of the lumber of the composite tie, yet more preferably greater than 80 volume percent, and still more preferably greater than 90 volume percent. In particular, the entire wood substance is derived from recycled ties, with the possible exception of wooden or composite plugs used to plug existing spike holes. Such a composite tie may be said to be substantially 100 percent derived from recycled ties.

In utilizing recycled ties in this fashion, the ties may be planed to remove splinters or warped, swollen, or rotted sections prior to further processing. For ties with good appearance and dimension, this step may be dispensed with. In either case, it is optional but desirable to plug spike holes with wood or composite fillers, for example but not by way of limitation, by boring a hole at the location of the spike and adhesively bonding a wooden dowel filler, or by injecting a filled or unfilled curable grout into the holes. A wood flour- or particle-filled polyurethane, vinyl ester, or epoxy thermosettable (crosslinkable) polymer grout may be used, for example, but not by way of limitation.

If the tie is badly weathered or damaged, it may be advisable to plane or saw a generous portion of the exterior of the tie and replace this portion with virgin lumber of suitable dimension, with a compressed wood product such as a particleboard or fiberboard as in U.S. Pat. No. 4,286,753, herein incorporated by reference, or with other molded material to supply "make-up" wood substance to replace that which has been removed by "machining" operations, i.e. planing, sawing, and the like. In general, the interior of used, recyclable ties will retain substantial integrity, and thus it is most often the exterior portions of the tie which will be replaced, if any. Missing materials may also be derived from virgin lumber sources and/or portions of other recycled ties.

In another embodiment, a substantial portion, i.e. 50 volume percent or more of the wood substance will be a pressed wood product or molded material composite. Pressed wood products generally consist of wood chips, flakes, strands, sawdust, flour, and the like, impregnated with a thermoplastic or thermosetting resin or other curable matrix, and cured under pressure to produce a pressed wood product. Particleboard, fiberboard, and oriented strand board are non-limiting examples of such products. In a more preferred embodiment, the pressed wood product may comprise recycled ties or portions thereof, i.e. shredded ties. Examples of such products are disclosed in U.S. Pat. No. 3,804,935 which is incorporated herein by reference. However, the production of such pressed wood products is well known. Pressed wood products may also contain other solid recycled particles, i.e. shredded fabrics, shredded products derived from recycling vehicles and consumer goods, etc.

Figure 2:
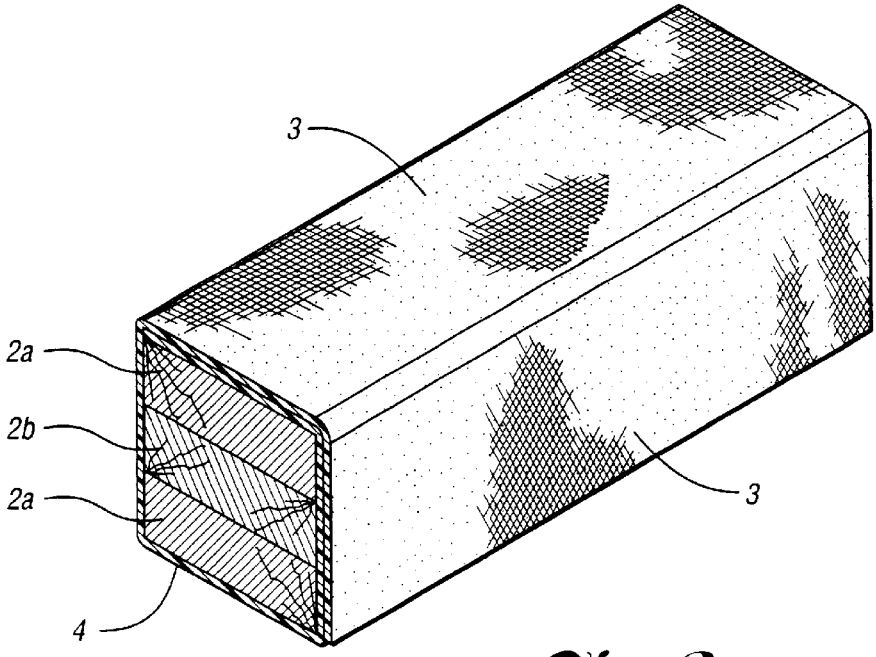
FIG. 2 illustrates a further embodiment of a composite tie of the subject invention, containing both a molded composite material and lumber portions.

When both lumber and pressed wood products are employed, these should be adhesively bonded together by a water-resistant adhesive, for example a resorcinol-type adhesive, an epoxy adhesive, urethane adhesive, etc. Crosslinkable PVA adhesives with suitable water resistance may also be used. Such adhesives are commercially available. An example of such a tie is shown in FIG. 2, wherein the core 2 is composed of two pieces of lumber 2*a* and a pressed wood portion 26.

When pressed wood products are to be used as the wood substance core, they may be used to the exclusion of wood lumber products, if desired. In general, products containing wood lumber have greater structural integrity and greater strength and resistance to bending loads as compared with an all-pressed wood core.

The core may also comprise a molded composite material. Such molded composite materials may be prepared by dispersing solid recycled particles as described previously into a continuous matrix and molding the core from this composite material. The recycled particles may contain no wood products, inadvertent wood products, or some amount of wood products. The amount of wood and the nature of other materials present as particles in the curable matrix will depend upon the source of the material. The matrix may be a thermosettable resin, i.e. epoxy, polyurethane, vinyl ester, unsaturated polyester, etc., or may be a thermoplastic such as polypropylene. The resins are generally selected for their mechanical properties and their economics, i.e. high cost resins are generally avoided. Combinations of thermoplastic and thermosetting resins may also be useful. By "molded material" it is meant a pressed composite material or molded composite material which may or may not contain wood particles, but which is prepared by admixing solid particulates with a continuous matrix and molding by casting, pressing, injection, etc., to form a product having the strength and other characteristics suitable for the core of the composite ties of the present invention. In the case of ties containing conduits, the "molded material" will include cementious material such as cement or concrete, as described below.

The present invention also pertains to composite ties containing integral cabling conduits, hereinafter referred to simply as "conduits." A conduit is a tubular metal or plastic structure, generally round, of a size suitable for receiving one or more signal, communication, or power cables. Conduits are generally of metal, such as the type sold commercially as "EMT." However, galvanized or black iron pipe is also suitable, as are also plastic conduits such as PVC, PVDC, polyolefin, etc. both reinforced and non-reinforced. Conduits of complex shape such as multiple "T" or "cross" configurations may be assembled from conventional components or manufactured especially for this use.

For conduits positioned transverse to the long axis of the tie, the conduit may be inserted by drilling a suitable hole through the tie, if not of cementitious material, and pressing or adhesively bonding the conduit in the tie. The conduit may have attachments to facilitate attaching to further exterior conduit, such as threaded ends, male and/or female, and may reside totally within the tie or may protrude, as shown in FIG. 1 at 5.

Figure 3:
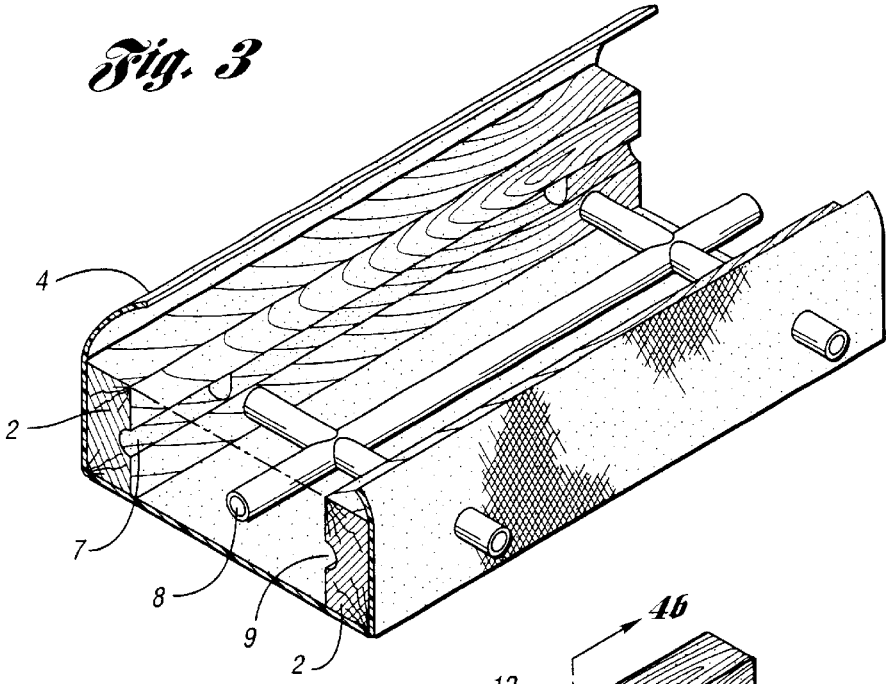
FIG. 3 illustrates an exploded view of one embodiment of a composite tie of the subject invention bearing a conduit.

For conduits which are directed parallel to the axis of the tie, it is generally impractical to bore a hole of this length. For such conduits, as shown in FIG. 3, in expanded view, the tie may be sawn into two (or three, etc.) pieces (1*a*, 1*b*) and channels 7,9 machined into the surface. Conduits 8 are inserted into the channels and the tie reassembled by adhesive bonding. The conduit may be adhesively bonded in as well, or grouted, sealed, etc., with traditional adhesives and/or sealants. When this process of construction is employed, conduits proceeding transversely may be provided, or both transverse and longitudinal conduits may be provided. Of course, conduits at various angles or of serpentine shape may be employed as well.

Figure 4:
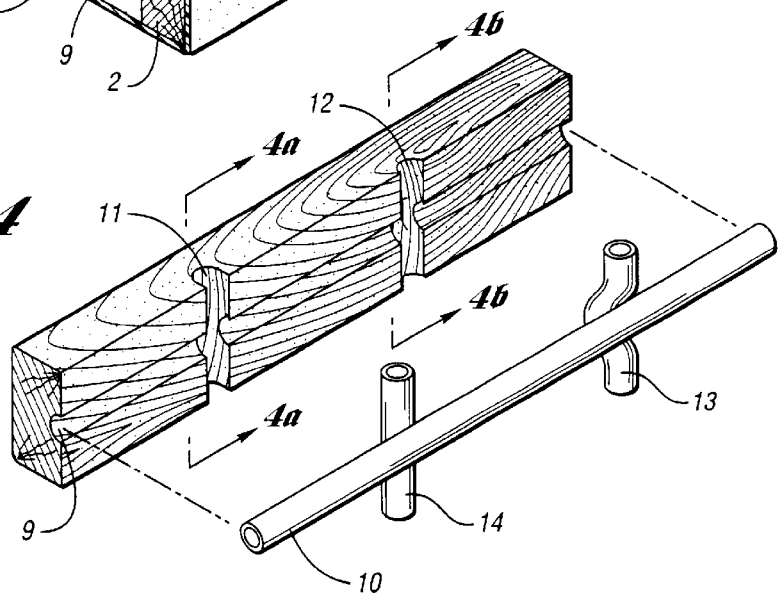
FIG. 4 illustrates an embodiment of a conduit-containing core of the composite ties of the present invention.
Figure 4A:
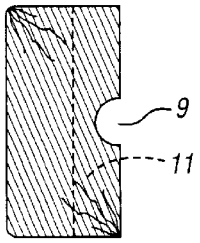
Figure 4B:
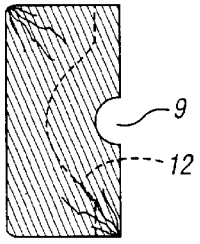
Figure 5:
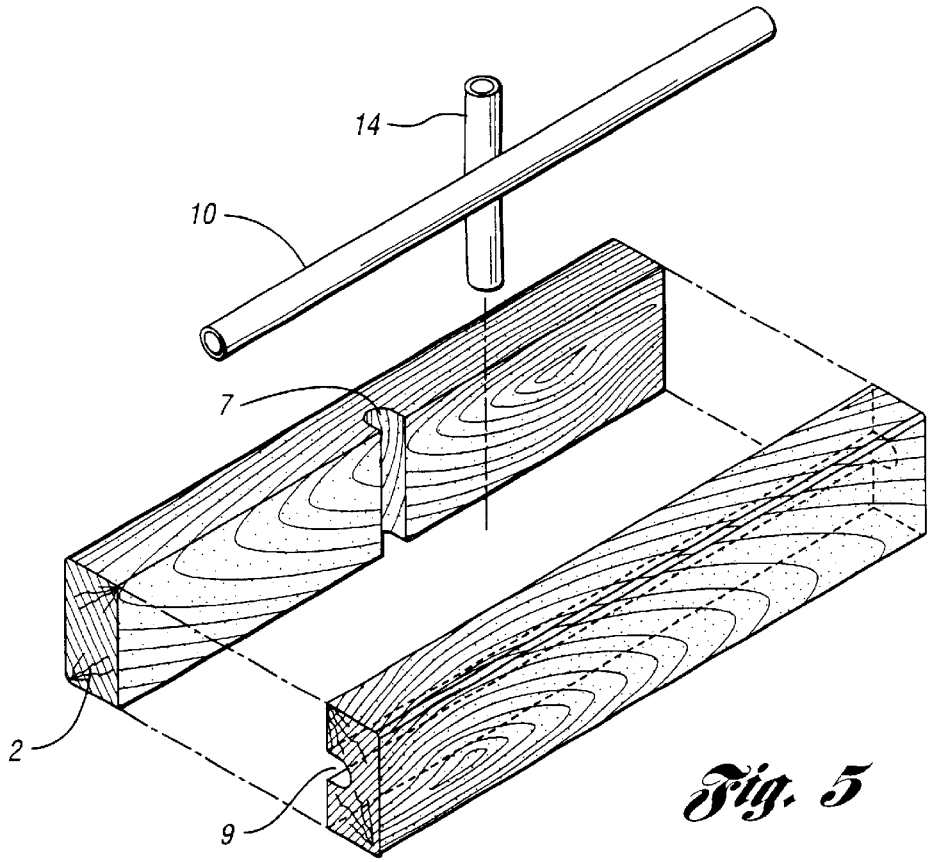
FIG. 5 illustrates a further embodiment of the conduit-containing core of the composite ties of the present invention.

In FIG. 4, a longitudinal channel 9 is provided for conduit 10, while a "straight" transverse channel 11 is provided below the longitudinal channel for a transverse conduit 14. At 12, the channel for a transverse conduit is bent such that a similarly bent conduit 13 can pass below the longitudinal conduit 10 where necessary but be closely housed by the channels at other positions. In FIG. 5, the channel 9 for the longitudinal conduit 10 lies completely within one section of tie while a cross-channel 7 for a transverse tie 14 lies within another section.

Figure 6:
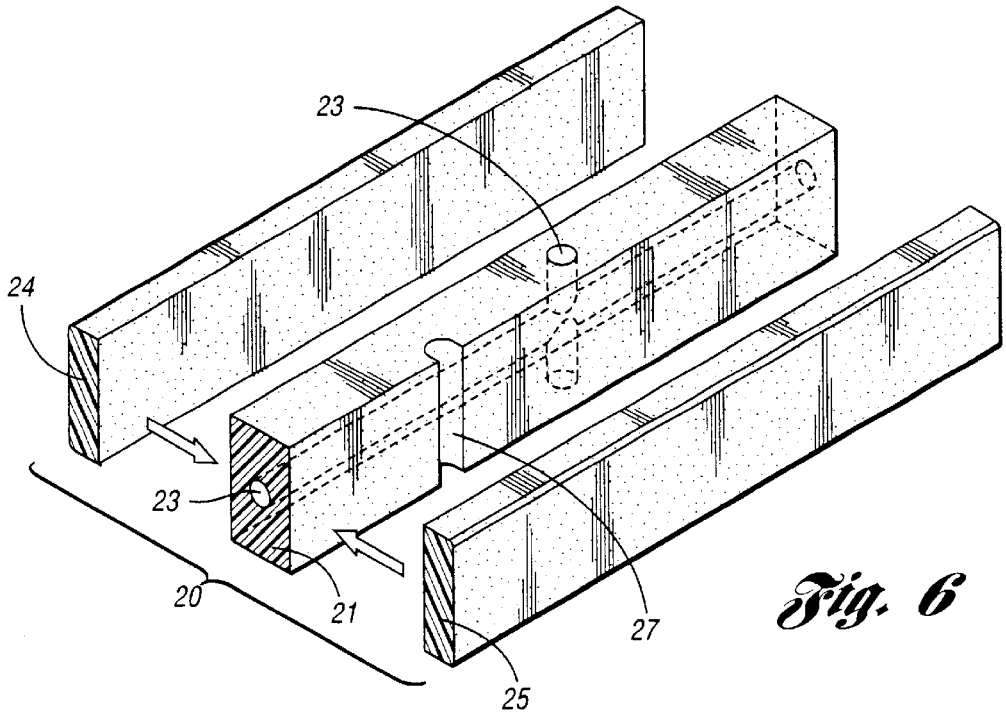
FIG. 6 illustrates a yet further embodiment of a composite tie containing a prefabricated, conduit-containing insert of molded composite material.

In an alternative embodiment as shown in FIG. 6, the conduit assembly 20 may be made of a molded material 21 with conduits 23 already in place, and adhesively bonded to tie sections 24,25. When materials such as highly filled and/or fiber reinforced thermoset or thermoplastic is used for the molded material, the material itself may form the wall of the conduit, without any separate conduit. The molded material may advantageously be a pressed wood product as described previously, and several "standard" versions of these may be separately molded for later assembly into conduit-containing composite ties of a desired configuration. In such ties with molded material, the molded material may also be molded to contain channels on one or both major surfaces 27 into which conduit may be inserted if desired, or left empty. In any case, the use of molded material inserts is particularly useful when a portion of the tie is to be removed due to poor surface quality, and where the difference in thickness must therefore be compensated. The molded portion may also constitute the entire core, i.e. without side portions 24,25.

Whatever the form of non-conduit containing cores, non-cementitious cores must be wrapped with curable fiber reinforcement to achieve the benefits of the invention. The fiber reinforcement may be provided as individual fiber strands (bundles of individual filaments) which are wrapped or woven around the core, i.e. by a multi-axial weaving machine known to the art, or preferably take the form of a woven fabric or tape or unidirectional tape which is wrapped around the tie.

Figure 7:
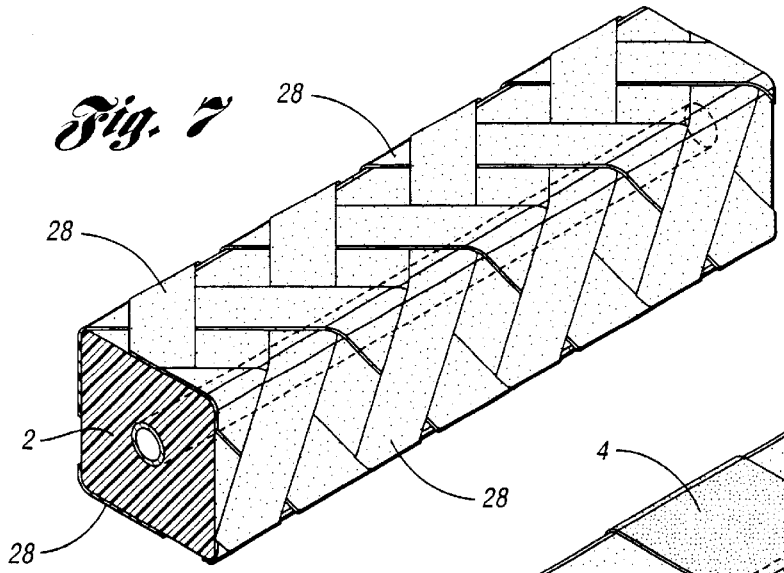
FIG. 7 illustrates a preferred method of overwrapping a tie with fibrous reinforcement.
Figure 8:
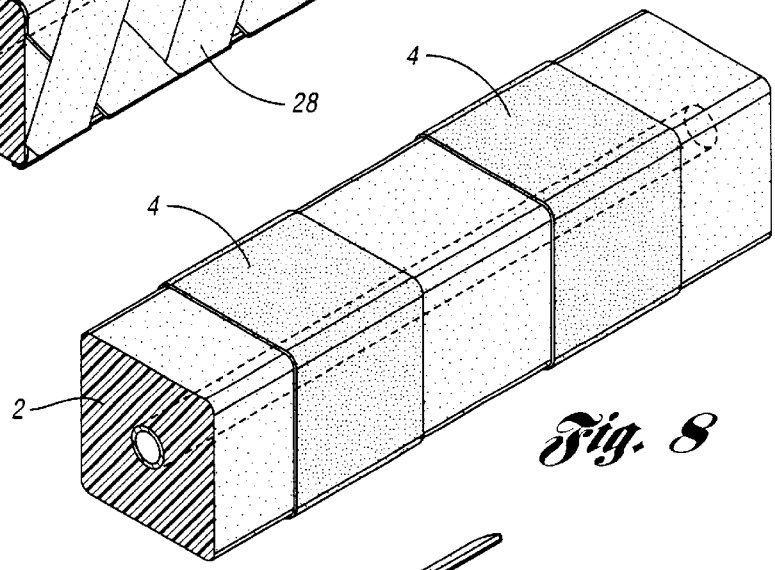
FIG. 8 illustrates a preferred embodiment of a wood-based tie where the fiberwrap includes the area of the tie where rail-holding spikes will be driven.

While it is possible to employ a fabric virtually of the same width as the length of the tie, and wrap the fabric around the core as shown in FIG. 1, it is preferable to employ a narrower fabric or tape 28 and wind around the core as shown in FIG. 7, where a "reverse wrap" is used to overlap the core in an "X" pattern. Moreover, it has been unexpectedly discovered that it is preferable not to tightly abut the tape reinforcement with the tape immediately adjacent, but to purposefully leave a gap. The gap facilitates removal of moisture from within the core. It has been found that an impervious coating such as would be provided by the wrap of FIG. 1, while practical, does not provide the same degree of weatherability as the previous wrap of FIG. 7, contrary to the teachings of the prior art such as U.S. Pat. No. 4,202,494, which teaches encasing the tie in a thin layer of water-impervious polypropylene. FIG. 8 discloses an embodiment where the fiberwrap 4 overwraps the core 2 specifically along portions where spikes may be driven. This represents a preferred embodiment.

The fiberwrap must be impregnated with a "curable" matrix. This curable matrix may be any liquid or solid (i.e. powder) materials capable of being cured or melted and solidified (in the case of a thermoplastic matrix) to produce a substantially permanent and continuous matrix around and among the fibers. For example, when ambient temperature cure is envisioned, typical thermoset resins such as polyurethane, epoxy, vinyl ester, unsaturated polyester, bismaleimide, cyanate, addition and condensation curing silicon resins, and the like may be used. Preference is given to epoxy resins, polyurethane resins, vinyl ester resins, and unsaturated polyester resins, with epoxy resins being particularly preferred. Some of the resins above, for example bismaleimide resins, can provide higher ultimate properties than epoxy resins but are not as cost effective as epoxy resins. Other thermosettable resins may be used as well. The above list is exemplary, and not limiting. The impregnation with the curable (or thermoplastic) matrix may take place prior to wrapping with fiber, i.e. a matrix resin or thermoplastic impregnated tape, etc., or may take place after wrapping an impregnated fiber reinforcing material around the tie. The term "consolidating" includes "curing" when thermosettable matrices are used, and melting and solidifying when thermoplastic matrixes are used.

If elevated temperature cure is desired, many of the above-identified resins may be used. However, elevated temperature cure allows resins such as solid epoxy resins, whether applied as an aqueous dispersion and dried, cast from solvent, or supplied in powder or other solid form, to be used. The curing generally takes place in an oven where the resin melts and then cures. The cured product forms a "continuous matrix." This matrix may not be totally continuous, but should be of sufficient quantity to form a fiber-reinforced structure. Portions may contain less matrix than other portions, and the wrap may contain voids due to the presence of resin-starved areas. Void-free fiber-reinforced wraps are preferred, however.

Thermoplastic resins may also be used. Such resins may be supplied as a film below and/or on top of the fiber tape and heated to impregnate the latter, preferably under modest pressure, i.e. by vacuum bagging. The thermoplastic may also be supplied from solution or from aqueous dispersion, or may be supplied in the form of comingled fibers or woven fabrics where thermoplastic strands and fiber reinforcing strands are woven together. The fabric is then heated to fuse the thermoplastic to form the matrix surrounding the fibers. Combinations of thermosetting and thermoplastic resins may be used.

The fibrous reinforcement itself may be virtually any reinforcing fiber. Such fibers include glass fibers, polyaramide fibers, polyamide fibers, polyolefin fibers, polyester fibers, and the like. Carbon fibers are also useful, and are preferred when cost allows their use. Presently most cost effective, however, are glass fibers. Standard woven fiberglass tape is available from many suppliers, for example. The term "polyamide" does not include polyaramids.

The fibrous reinforcement may be in the form of strands (bundles of individual filaments), tow, yarn, woven or non-woven tape, fabric, etc. All or a portion of the fiberglass may be spun (as is commonly used in building insulation products) or felted. Felted reinforcement is often produced by needle punching unidirectional, woven, or random fiber products or combinations of these with a needle board of barbed needles which break and entangle fibers. The amount of continuous fiber left in the product is determined by the degree of punching and the size of the barbs. Felted material is commonly available, and is used, for example, in glass mat thermoplastic (GMT) products, which are themselves suitable as a fiber-reinforced thermoplastic wrap.

In general, the fibrous reinforcement must overlap itself to provide suitable reinforcing strength. Thus, when a single wide fabric such as shown in FIG. 1 is used, it is desirable to overlap at least one ply of fabric, as shown at 6 in FIG. 1. When employing tape, it is preferable to wrap the tape continually around the core in one direction followed by a reverse wrap in the opposing direction, thus forming a "lattice" or "X" configuration. Additional wrap layers may follow. Furthermore, areas of concentrated stress, for example where spikes are to be inserted, may be wrapped with more plies or with different kinds of plies than other portions of the structure. For example, non-woven (felted) pads containing matrix resin may be applied in these areas.

In the case of conduit-containing cores, it is also preferable that the core be fiber-wrapped when the core is comprised all or in part of wood lumber material. When the entire core or a substantial portion thereof is composed of molded composite material which is molded around the conduit(s), fiber wrapping is still preferred when the composite material consists of wood fibers or particles, cellulosic particles, and the like, although wrapping is not mandatory in such cases.

When the core is prepared from cementitious material, i.e. reinforced or non-reinforced concrete, with or without aggregate material added, the conduit-containing tie may advantageously be manufactured without a fiber wrap. For such ties, since driving of spikes is prohibited, attachment means for rails must be provided, for example but not by way of limitation, either during manufacture by incorporating threaded fasteners, etc. at the appropriate location, or following manufacture by adhesively bonding appropriate fastener means, i.e. metal plates containing suitable locators and/or fasteners. The cementitious composite material molded ties may also be fiber wrapped, however.

The conduit-containing ties molded from cementitious materials may be produced by known molding processes, i.e. in open molds, with or without assistance of vibration to aid in compaction. These ties may also be manufactured by conventional pressure molding techniques. The cementitious molding material may contain long or short fiber reinforcement, and may contain, in a non-limiting sense, traditional fillers and aggregates, including sand, fly ash, ground stone, crushed stone, gravel, etc., and may also contain polymer additives such as dispersions of addition polymers such as polyvinyl acetate, ethylene vinyl acetate polymers, styrene-butadiene polymers and the like to enhance properties, as well as viscosifiers and setting and retarding agents.

The cementitious ties may be molded in one piece, i.e. with the conduits positioned in a suitable mold such as a multi-part mold, with the ends of the conduit extending through or partially through the sides of the mold. Alternatively, the open ends of the conduit may be made flush with the interior mold surface and a removable cap of wood, metal, plastic, etc., inserted or attached to the open ends of the conduit to prevent entry of cementitious material. For example, but not by way of limitation, the ends of the conduit may be internally threaded and a removable externally threaded insert introduced. Following casting, the threaded insert is removed, exposing the cementitious-free conduit interior. As a further example, a cup-like plastic cap may be inserted over the end of the conduit. Following molding, the plastic cap need not be removed in its entirety, only the portion which covers the end of the conduit will be punctured or cut away. Conduits which will not be used initially may retain their caps, inserts, or other cover devices permanently or until a decision is made to utilize the portion of embedded conduit associated with them.

It is preferable, however, to cast the cementitious ties in two or more standard sections, for example, without any conduit present. The casting or molding may take the form shown in FIG. 4, for example, with channels for conduits 9, 12, etc., molded into the casting. The castings are preferably substantially identical at their mating surfaces, although it is not unusual for the topmost surface, i.e. the surface upon which the rails will be mounted, to have camfered edges.

Figure 9:
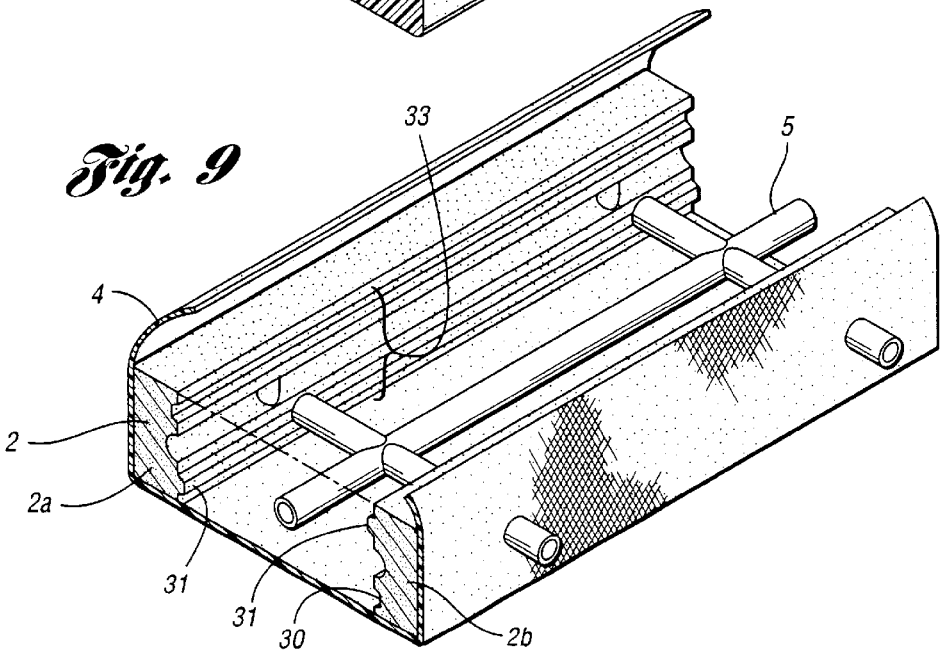
FIG. 9 illustrates a preferred embodiment of a cementitious, two part, fiberwrapped, conduit-containing tie.

A preferred embodiment is shown in FIG. 9, where the core 2 comprises two complementary molded portions 2*a* and 2*b*. These sections are molded to contain at least one conduit receiving channel 32. The edges of face 33 may be other than flat, as shown by matching protrusions 31 and recesses 30. This enlarges the bonding area substantially. The conduit 5 is inserted prior to assembly, adhesively bonded along the respective faces, and overwrapped with fiber wrap 4. While the tie shown is in two portions joined together vertically, i.e. the adhesively bonded faces are vertically oriented from the roadbed, the two portions may be oriented horizontally along their length, for example as top and bottom portions.

Following manufacture of the castings, conduits are inserted into the hollows designed to receive them prior to assembly of the tie by joining together the two halves. The conduit may be secured in their receiving channels by cementitious or polymer grouts, asphaltic substances, or by other means, or no securing means may be used. The two halves are preferably assembled employing an adhesive. Although cementitious adhesives (i.e. mortar, portland cement, etc.) may be used for this purpose, a stronger assembly will be made using a polymer adhesive, for example an epoxy adhesive. Such adhesives are well known to the building trades, and have been used, for example, to adhesively bond cast concrete bridge sections together. The one-piece cementitious, conduit-containing ties are optionally fiber wrapped. It is highly preferred that the two piece (or multiple piece) cementitious ties be fiber wrapped as well.

The resulting wood-based composite ties are sturdy and weather extremely well. Moreover, they are considerably stronger than similar ties produced without the fiberwrap. Importantly, the ability to retain spikes is the same or better than ties without the fiberwrap. The conduit-containing cementitious ties, when fiber-wrapped, exhibit greater strength properties and greater resistance to moisture-induced damage.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A composite railroad tie having at least four elongate major sides and two end portions, comprising a) an elongate core, and b) surrounding said core, an overwrap of fibrous reinforcement, fibers of said fibrous reinforcement associated with a cured continuous matrix, said overwrap extending over at least a portion of all the major sides of said tie, further comprising at least one conduit contained within said tie.

2. A composite railroad tie having at least four elongate major sides and two end portions, comprising a) an elongate core, and b) surrounding said core, an overwrap of fibrous reinforcement, fibers of said fibrous reinforcement associated with a continuous thermoplastic matrix or a continuous cured thermnoset matrix, said overwrap extending over at least a portion of all the major sides of said tie, wherein said core is a wood substance comprising all or a substantial portion of a used railroad tie, said wood substance comprising two longitudinal portions, at least one of said two longitudinal portions having at least one channel in a face thereof, said channel containing at least one conduit, said at least two longitudinal portions adhesively bonded together such that said conduit is maintained within said wood substance between said two longitudinal portions.

3. The tie of claim 2 wherein said tie contains at least one longitudinal conduit extending through the length of the tie.

4. The tie of claim 2 wherein said tie contains at least one longitudinal conduit extending through the length of the tie and at least one transverse conduit extending through a thickness of the tie.

5. The tie of claim 1 comprising two lumber portions from used railroad ties, and a molded material composite between said two lumber portions, said molded material composite preconfigured to contain at least one channel adapted to receive a conduit, or preconfigured to contain at least one conduit.

6. A process for refurbishing used railroad ties for reuse, said process comprising:

a) obtaining a used railroad tie;

b) overwrapping said used railroad tie with a thermoplastic or thermosetting curable matrix containing fibrous reinforcement around all four major sides of said used railroad tie; and consolidating the matrix to form a composite refurbished railroad tie, wherein prior to said step of overwrapping said used railroad tie is sawed along its length to provide at least two longitudinally extending portions, at least one conduit is positioned between said at least two longitudinally extending portions, and said at least two longitudinally extending portions are adhesively bonded to form a conduit-containing core.

7. The process of claim 6 wherein a face of at least one of said two longitudinally extending portions is machined contain at least one conduit-receiving channel, further comprising inserting at least one conduit into at least one of said at least one conduit-receiving channels, and adhesively bonding said at least two longitudinally extending portions with said conduit between them.

8. The process of claim 7 wherein said channels are machined in only one of said at least two longitudinally extending portions.

9. The process of claim 6, wherein said conduit is contained within or formed by the walls of a molded composite material, further comprising positioning said molded composite material between said at least two longitudinally extending portions, and adhesively bonding said molded composite material to said longitudinally extending portions.

* * * * *